United States Patent [19]

Granger et al.

[11] 3,947,227

[45] Mar. 30, 1976

[54] BURNERS

[75] Inventors: James Peter Granger, Staines; Kenneth Hirst, Kemsing; David Montagu Whitehead, Camberly, all of England

[73] Assignee: The British Petroleum Company Limited, London, England

[22] Filed: Jan. 8, 1974

[21] Appl. No.: 431,607

[30] Foreign Application Priority Data

Jan. 15, 1973 United Kingdom ..... 1986/73

[52] U.S. Cl. ..... 431/118; 431/328

[51] Int. Cl.[2] ..... F23D 5/12

[58] Field of Search ..... 431/328, 329, 117, 118

[56] References Cited

UNITED STATES PATENTS

| | | | |
|---|---|---|---|
| 2,227,899 | 1/1941 | Grubb | 431/328 |
| 2,229,717 | 1/1941 | Brace et al. | 431/328 |
| 3,425,058 | 1/1969 | Babington | 431/117 |
| 3,635,651 | 1/1972 | Desty | 431/328 |
| 3,650,661 | 3/1972 | Laguinia | 431/328 |
| 3,691,764 | 9/1972 | Ware | 431/328 |
| 3,724,994 | 4/1973 | Desty | 431/328 |

*Primary Examiner*—Carroll B. Dority, Jr

*Attorney, Agent, or Firm*—Morgan, Finnegan, Pine, Foley & Lee

[57] ABSTRACT

A metal foam burner element holds liquid fuel by capillary action. The element is in contact with one or more fuel feed pipes connected to a pressurised fuel supply. The element has air passageways through it so that combustion takes place between air passing through the element and the fuel.

9 Claims, 4 Drawing Figures

FIG. 1.
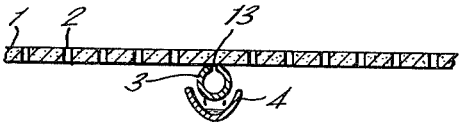
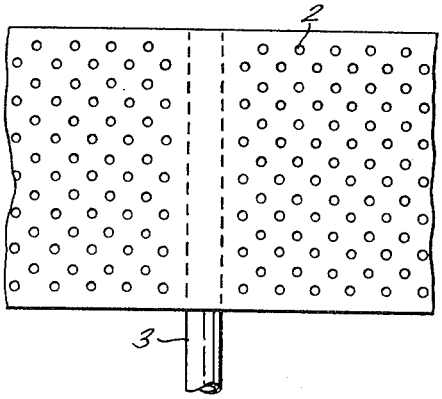
FIG. 2.
FIG. 3.
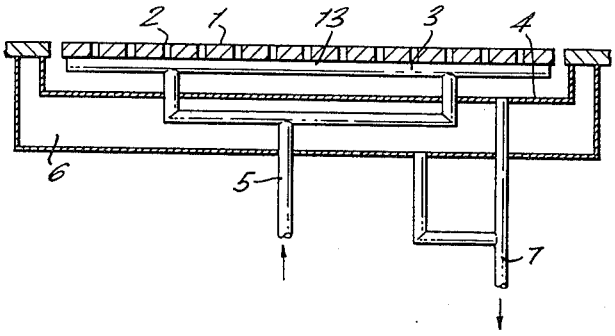
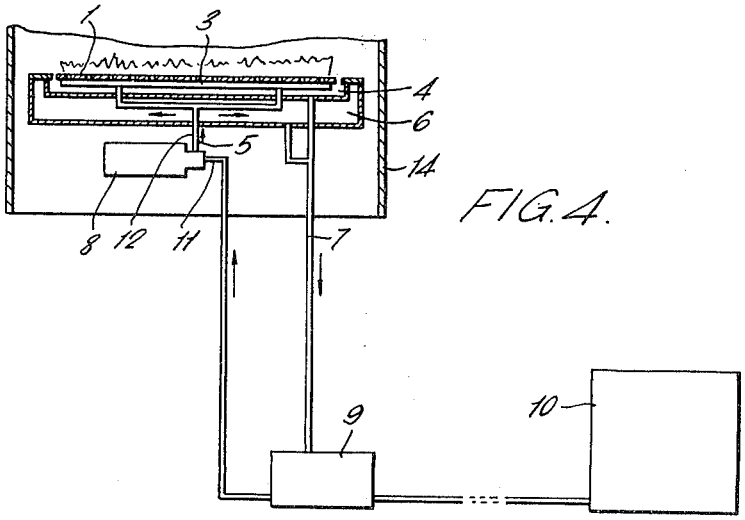
FIG. 4.

BURNERS

This invention relates to burners and in particular to burners which operate on vaporisable liquid fuels such as kerosene.

It is know to burn liquid fuels for heating purposes in wick burners wherein the wick enables transference of fuel from a reservoir to the combustion zone. An example of this type of burner is shown in British patent specification No. 1,247,406.

We have now discovered an improved burner element or wick which gives improved combustion characteristics.

According to the invention there is provided a burner element at least part of which can hold liquid fuel by capillary action which element is adapted for contact with a fuel supply supplying fuel under pressure to said element, the element having air passageways through it so that, during the use of the element as a component of a burner burning a liquid fuel, combustion takes place between air passing through the air passageways and the fuel.

Preferably the fuel supply comprises one or more fuel feed pipes.

Generally speaking, the combustion zone will be situated substantially adjacent to the burner element but it is also possible to transport the combustible mixture to a point remote from the element where combustion then takes place.

The burner element is preferably made from a metal foam material. A suitable material is a metal foam of nickel plated plastic (open cell polystyrene) with a flash coating of chromium for strength. Also other materials may be suitable e.g. metal filled plastics, porous ceramic materials and sintered metals.

The fuel feed pipe may also be 'sandwiched' between layers of burner elements.

It will usually be desirable to use the thinnest element consistent with achieving the necessary fuel transfer since the greater the thickness the greater the heat capacity of the element and the fuel contained therein. A low heat capacity facilitates ignition since the smaller the heat capacity the more easily the fuel is vaporised and ignited. (Ease of ignition is particularly important in the case of a burner which is turned on and off by an automatic control system). A thin element confers an additional advantage when the burner is turned out. Combustion continues until the supply of fuel contained in the element is exhausted and this exhaustion is more satisfactorily achieved when the supply is small, i.e. when the element is thin. It is preferable that the element is less than 10 mm thick and for certain application, e.g. domestic central heating, it is preferable that the element be less than 5 mm, and most preferably less than 3 mm, thick.

In order to achieve uniform air distribution it is desirable that the air passageways be uniformly distributed over the element.

The air passageways are preferably air holes which are preferably circular in shape and preferably of an area of 0.01–1.0cm$^2$. The number of air holes is such that they account for preferably 25–55 percent of the total area of the element. The air passageways can also be in the form of slits or other suitable shapes.

The invention includes both rigid and non-rigid wicks.

Non-rigid wicks are made of flexible material, e.g. ceramic fibres, and therefore, since the wick would collapse under its own weight, it must be used in conjunction with a support member adapted to hold the wick in the required configuration. On the other hand rigid wicks, e.g. wicks made of a porous metal such as a metal foam, are capable of supporting their own weight and therefore no support member is necessary.

Anisotropic wicks are particularly suitable for most applications. Examples of these are crushed metal foam where the pore size is smaller measured in the direction of air flow than at right angles thereto and a mat of ceramic fibres where there is a lower resistance to liquid flow in a horizontal direction than in the vertical direction.

Anisotropic wicks have the property of facilitating fuel flow in desired direction (i.e. across the element to achieve uniform fuel distribution) but hindering fuel flow in undesired directions (e.g. in a horizontal position to counteract fuel dripping out of the wick).

Ignition of the burner may be manual e.g. by naked flame or automatic e.g. by electrical means, such as spark ignition.

Preferably a drain trough is provided below the burner element so as to collect excess fuel dripping from the fuel outlets of the feed pipe.

The use of a pressurised fuel supply to the burner element means that normally the element is saturated with fuel and any excess fuel dripping from the element is collected in the drain trough. Thus the element or a part of the element is subject to continual flushing which aids in reduction of carbon build up caused by cracking of the fuel.

Further the fuel is contained in a system which reduces the possibility of flooding outside the burner. The burner has a low fuel capacity outside the element thus enabling a rapid flame out and elimination of fuel from the burner.

The fuel outlets in the feed pipe may be of any suitable shape e.g. circular or slits and are suitably arranged so as to give an even fuel distribution across the burner element. Preferably the total cross-sectional area of the fuel outlets of a feed pipe is not greater than the cross-sectional area of said feed pipe.

The burner element is normally used in a substantially horizontal position but may also be used in other orientations e.g. vertical, depending upon the required mode of application of the burner element.

The invention will now be described with reference to FIGS. 1 to 4 of the drawings accompanying the provisional specification.

FIG. 1 is a vertical cross-section of a burner having a foam metal burner element.

FIG. 2 is a top view of the burner shown in FIG. 1.

FIG. 3 shows an embodiment of the burner element having a twin inlet fuel supply.

FIG. 4 illustrates a burner in practical operation e.g. a central heating unit, having a high mounted heating unit.

The burner element 1 shown in FIG. 1 is in the form of a flat rectangular slab of crushed metal foam. The element 1 is pierced by air holes 2 arranged in an hexagonal pattern. The particular foam used was a metal foam made from nickel plated open cell polystyrene foam with a flash coating of chromium for strength.

The element 1 was made from a block of metal foam which had an average pore diameter of 0.3 mm by crushing it parallel to its axis in the ratio 3:1 and the air holes 2 were cut at the same time. This compression yields an anisotropic element. The compression converted the pores (which were originally irregular dodecahedra in shape) to voids which were thin in the vertical direction.

A fuel feed pipe 3 was affixed to the underside of the element by means of an adhesive. This feed pipe 3 has fuel outlets 13 of suitable shape e.g. circular holes, slits etc. on the top side and in contact with the under side of the element 1. The fuel outlets 13 are distributed so as to give an even distribution of fuel across the element 1 when fuel is pumped into the fuel feed pipe 3.

On the underside of the fuel feed pipe 3 there is provided a drain trough 4 so as to collect any excess fuel that may drip down from the fuel outlets 13.

FIG. 2 shows a top view of the foam metal burner element 1. For kerosine fuel, the optimum thickness of the element was of the order 1 mm. A slightly thicker element was used when the fuel used was gas oil.

For a typical burner element with circular air holes the dimensions are as follows:

| | |
|---|---|
| Length | 245 mm |
| Breadth | 45 mm |
| Thickness | 1.2 mm |
| Diameter of air holes | 3.0 mm |
| No. of air holes | 480 |
| Total Area of air holes | 3395 $mm^2$ |

FIG. 3 shows a further embodiment of the invention in which the fuel feed pipe 3 has two inlet positions for receiving fuel. This arrangement enables a better distribution of fuel in the burner element 1 to be obtained. As the fuel is supplied to the feed pipe from header 5 under a small pressure, the burner element 1 becomes saturated with fuel and the excess drips off into the drain trough 4. This means that the element 1 is subjected to continual flushing by fuel and carbon build up as a result of heat or imcomplete combustion is reduced. The excess fuel is collected and recycled by means of drain off line 7.

Air is supplied to underside of element by means of a forced draught i.e. by use of an air pump.

Referring to the system shown in FIG. 4, fuel is transported to the burner element 1 from a fuel storage system 10 situated below the level of the burner by means of a pump 8. The particular pump employed was an electrically operated diaphragm pump. A fuel level control 9 is located in the fuel supply line in between the fuel pump 8 and fuel storage system 10 and is further connected to the fuel drain-off line 7 of the element 1 so as to allow recycling of excess fuel.

The fuel level control 9 is used to avoid the pump 8 sucking back air which would occur if the drain-off line 7 was directly connected to the pump inlet tube 11.

In use of the burner system, fuel is pumped from the fuel level control 9 then along pump inlet tube 11 into the pump 8 and thence along pump outlet tube 12 into the burner element. The fuel pressure supplied to the burner element is only of the order of a few inches water gauge.

If the fuel storage system 10 is situated above the burner element 1, then the fuel level control 9 tray may be mounted inside enclosure 14. Also it is possible to replace the pump 8 and fuel level control 9 with an accurate fuel metering pump.

Automatic ignition is conveniently achieved by an electrical system (not shown in any drawing). The system may comprise either a coil heater for heating and igniting a small area of the element or an electrode for generating sparks in co-operation with the (metal foam) element. To achieve ignition the ignition system is switched on and the fuel is restarted. When the liquid fuel reaches the heated area some vaporises and the vapour is ignited by the sparks. This produces a flame which spreads over the whole area of the burner.

The burners described may comprise part of a domestic central heating appliance, for example, the hot water circulating type. Further the burner system shown in FIG. 4 is not dependent on gravity feed and so makes possible fuel storage below ground or in basements.

It has been found possible to operate the burner system continuously for up to 1000 hours before excessive carbon build up on the element occurs. It has been found that operation on and on-off cycle reduces the rate of carbon build up on the element and thus may further extend burner operating times.

We claim:

1. A burner comprising: a burner element formed of a slab of material which is adapted and arranged to hold liquid fuel by capillary action and defining air passageways therethrough for the passage of combustion air to a combustion zone at the surface of the burner element; means supplying fuel under pressure in said element in an amount in excess of that required to saturate said element thereby to cause the element to be flushed and to remove carbon build up therefrom during the entire normal operation of the burner, said excess fuel dripping from the underside of the element said means including an elongated pipe having a plurality of orifices abutting the burner slab material and directed toward the combustion zone for directing the fuel into the burner slab material; and means for collecting and recycling the excess fuel to said supplying means; the combustion air and fuel vapors from the burner element being mixed and reacted above said element.

2. A burner according to claim 1 in which, the total cross-sectional area of the orifices is not greater than the cross-sectional area of the pipe.

3. A burner according to claim 1 in which said element is made from a metal foam material.

4. A burner according to claim 3 in which the metal foam material is a metal foam of nickel plated plastic with a flash coating of chromium.

5. A burner according to claim 1 in which said element is made from a metal filled plastics material, a porous ceramic material or a sintered metal.

6. A burner according to claim 1 in which said element is less than 10 mm. thick.

7. A burner according to claim 6 which is less than 3 mms. thick.

8. A burner according to claim 1 in which said air passageways are air holes of circular shape, each air hole having an area of from 0.01 to 1.0$cm^2$.

9. A burner according to claim 8 in which the air holes account for from 25 to 55 percent of the total area of the element.

* * * * *